United States Patent [19]

Coyle

[11] Patent Number: 4,926,512

[45] Date of Patent: May 22, 1990

[54] FOLDING PAPERBOARD BEACH CHAIR

[76] Inventor: Brian D. Coyle, 205 Get-a-Way La., Bahama, N.C. 27503

[21] Appl. No.: 442,144

[22] Filed: Nov. 28, 1989

[51] Int. Cl.[5] ..... A47C 7/16

[52] U.S. Cl. ..... 5/417; 5/419; 5/432; 5/DIG. 1; 297/377; 297/457

[58] Field of Search ..... 5/77, 417–420, 5/432, 433, DIG. 1; 297/352, 377, 378, 382, 454, 457

[56] References Cited

U.S. PATENT DOCUMENTS

| | | | |
|---|---|---|---|
| 1,659,405 | 2/1928 | Love . | |
| 1,842,424 | 1/1932 | Ponten et al. . | |
| 1,915,504 | 6/1933 | Stokby . | |
| 2,940,511 | 6/1960 | Gomes . | |
| 2,940,513 | 6/1960 | Holden . | |
| 3,041,637 | 7/1962 | Emery | 5/433 |
| 3,053,569 | 9/1962 | Clark, Jr. | 297/4.57 X |
| 3,087,170 | 4/1963 | Emery | 5/77 X |
| 3,121,884 | 2/1964 | Emery | 5/433 |
| 3,312,503 | 4/1967 | Suzuki | 297/442 |
| 3,627,086 | 12/1971 | Calgan | 190/8 |
| 4,370,767 | 2/1983 | Fraser | 5/417 |
| 4,654,907 | 4/1987 | Haugard | 5/420 |
| 4,775,188 | 10/1988 | Fuchs et al. | 297/380 |
| 4,804,230 | 2/1989 | Friedman | 297/457 |
| 4,869,553 | 9/1989 | Powell | 5/419 X |

*Primary Examiner*—Michael F. Trettel

*Attorney, Agent, or Firm*—Richard E. Jenkins

[57] ABSTRACT

An inexpensive and lightweight folding paperboard beach chair is formed from a single scored blank of paperboard. The elongated paperboard body has two spaced-apart and transverse score lines which define a bottom leg support panel, a middle seat support panel, and a top back support panel wherein the bottom and top panels are adapted to be folded so as to overlay the middle panel. A plurality of spaced-apart foldable support panels extend across the back of the top back support panel to provide support for the panel when the chair is unfolded, and are further adapted to fold upon and overlay the top panel when the chair is folded. An aperture is provided adjacent to the side edge of each of the top, middle, and bottom panels and positioned so as to be in vertical registration and to thereby form a carrying handle when the chair is folded into its closed configuration with the top and bottom panels overlaying the middle panels thereof.

6 Claims, 4 Drawing Sheets

FOLDING PAPERBOARD BEACH CHAIR

DESCRIPTION

1. Technical Field

The present invention relates to a portable folding paperboard chair which is particularly adapted for use at the beach, pool, picnic grounds, and the like.

2. Background Art

The field of the folding paperboard chair art is replete with various types of foldable chairs for the beach and the like which are of relatively complex construction. For example, U.S. Pat. No. 3,627,086 to Calgan et al. discloses a combined seat and article carrying case, U.S. Pat. No. 2,940,511 to Gomes discloses a collapsible seat and advertising piece, U.S. Pat. No. 3,312,503 to Suzuki discloses a paperboard chair, U.S. Pat. No. 4,775,188 to Fuchs et al. discloses a folding combination chair seat and carrying case, and U.S. Pat. No. 2,940,513 to Holden discloses a paperboard chair.

However, all of the prior art folding chairs known to applicant are relatively complex and not really suited to providing a truly portable and comfortable disposable folding chair for use on the beach and related recreational type uses. Thus, the search for a more perfect portable and disposable folding chair has continued.

DISCLOSURE OF THE INVENTION

In accordance with the present invention, applicant provides a folding paperboard beach chair designed specifically for ease of carrying and use as well as very economical manufacturing cost so as to facilitate disposability subsequent to use during a beach vacation or the like. The chair comprises an elongated paperboard body with two spaced-apart and transversely extending score lines which define a bottom leg support panel, a middle seat support panel, and a top back support panel, wherein the bottom and back panels are adapted to fold upwardly and over the middle panel so as to overlay the middle panel when folded for carrying. Two spaced-apart, foldable support panels extend transversely across the back of the top panel to provide back support when the chair is open and the support panels are adapted to fold upon and overlay the top panel when the chair is closed by folding the top and bottom panels over the middle panel. The bottom, middle and top panels each have an aperture therein adjacent to one side which are in vertical registration when the chair is folded so as to form a carrying handle for the folding paperboard beach chair of the invention.

An object of the present invention is to provide a lightweight and inexpensive folding paperboard beach chair which is particularly adapted for ease of use and transportation to and from the site of use.

Another object of the invention is to provide a folding paperboard beach chair which is readily and cheaply manufactured so that it may be disposed of after use.

Yet another object of the present invention is to provide a folding paperboard beach chair which while inexpensive to manufacture is easy to open and close and which provides rigid support to maintain the user in a substantially upright sitting position and to further protect the entire extent of the user's body from contact with sand.

Some of the objects of the invention having been stated, other objects will become evident as the description proceeds, when taken in connection with the accompanying drawings.

BEST MODE FOR CARRYING OUT THE INVENTION

Figure 1:
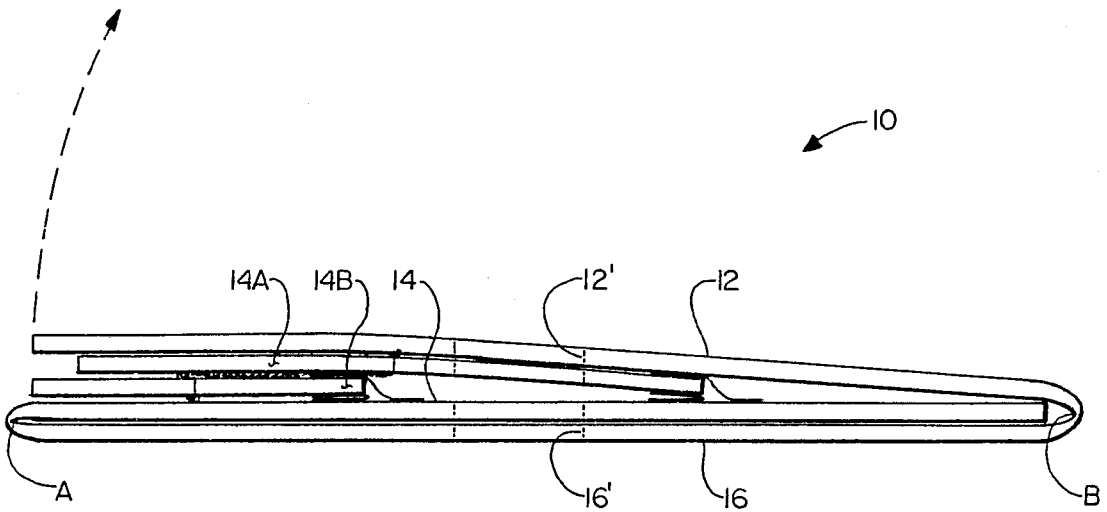
FIG. 1 is a side elevation view of the chair folded in its carrying position.
Figure 2:
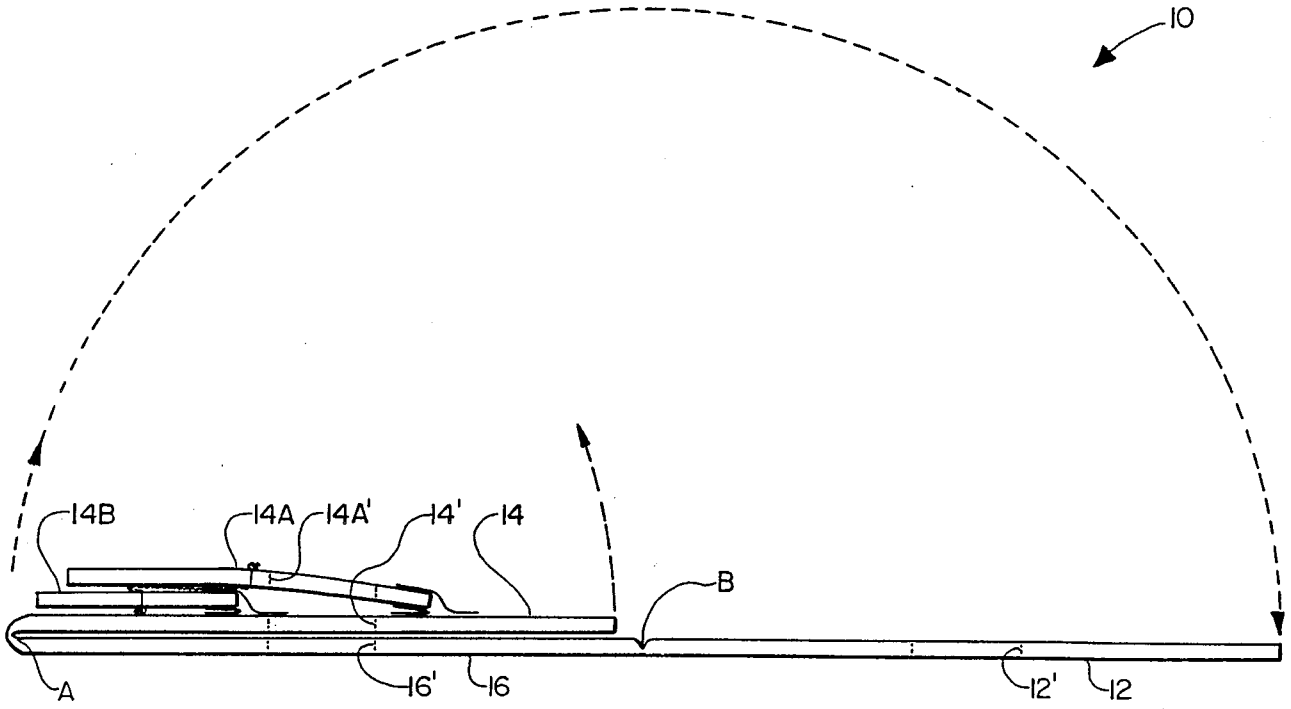
FIG. 2 is a side elevation view of the chair with the bottom leg support panel being raised in order to open the folded chair for use.
Figure 3:
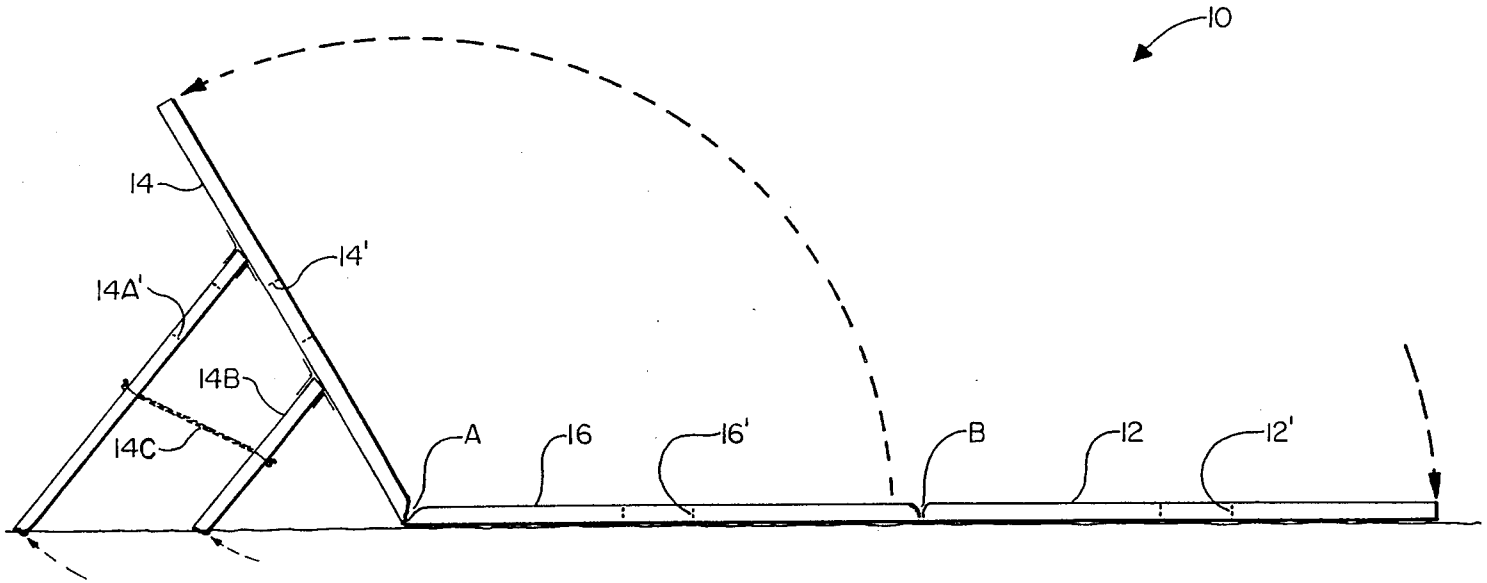
FIG. 3 is a side elevation view of the chair with the top back support panel now also raised in order to further unfold the chair for use.

With reference now to FIGS. 1–4 of the drawings, a folding paperboard beach chair constructed in accordance with the present invention is shown and generally designated 10. With specific reference no to FIG. 1, chair 10 is shown in its fully folded and closed position wherein it is particularly well suited for carrying due to its lightweight and compact construction. Once chair 10 has been transported to a suitable site for use, such as a beachfront location, bottom leg support panel 12 which overlays both top back support panel 14 and middle seat support panel 16 is unfolded as best appreciated with reference to FIG. 2 of the drawings. Next, top back support panel 14 which now overlays middle seat support panel 16 is unfolded and positioned in a generally upright position as can best be seen with reference to FIG. 3. Support panels 14A and 14B (which extend across the back of top back support panel 14 and are foldably secured thereto) are unfolded and positioned at a substantially perpendicular angle to top panel 14 so as to render top panel 14 substantially rigid in order to comfortably support the back of a user of chair 10 thereon.

It should be appreciated that support panel 14B is foldably secured across the medial portion of back panel 14 and support panel 14A is foldably secured across the top portion of top panel 14, and that support panel 14A is of greater length than support panel 14B in order that back panel 14 will be suitably supported in an upright but reclining position.

In order to facilitate ease of positioning of support panels 14A , 14B, a cord 14C extends therebetween which is secured at each end to a respective one of support panels 14A , 14B. Thus, when unfolding support panels 14A , 14B from top panel 14 in order to properly orient top panel 14 at a desired reclining angle, the user merely has to unfold support panel 14A and it will carry support panel 14B therewith in a parallel relationship due to interconnecting cord 14C.

Figure 4:
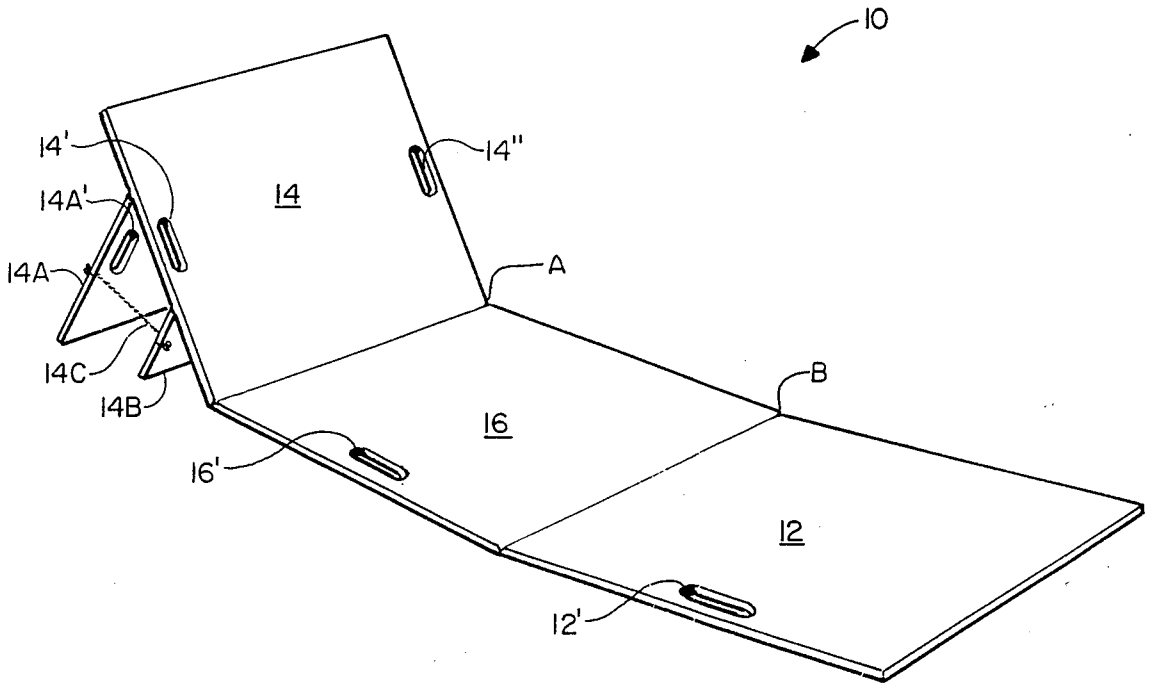
FIG. 4 is a perspective view of the chair of the present invention in its fully unfolded position for use on the beach wherein the support panels have been unfolded from the top back support panel so as to extend downwardly and substantially perpendicularly thereto to provide support to the top back support panel.

With specific reference now to FIG. 4, chair 10 is shown unfolded and positioned for use. Typically, the user would recline on chair 10 with his back against and supported by top back support panel 14, his buttocks positioned on and supported by middle seat support panel 16, and his legs positioned on and supported by bottom leg support panel 12. Although other configurations are certainly possible, in the preferred embodiment of the invention contemplated by applicant panels 12, 14, and 16 are of substantially the same width and length so that when folded upon each other they will be substantially coextensive in order to provide greater compactness and ease of carrying for folded chair 10. Also, although other means are possible, applicant presently contemplates use of a suitable fiberglass tape (not shown) to foldably secure support panels 14A , 14B to the back side of top back support panel 14. Furthermore, although many types of cardboard could be used to construct the chair of the present invention, applicant prefers a 275 lb. weight, double-wall, type C flute cardboard product for use in constructing panels 12, 14, 16, as well as support panels 14A , 14B of chair 10. The cardboard is scored at two spaced-apart score lines A and B in a conventional manner in order to adapt panels 12 and 14 for being folded in overlaying position with respect to middle panel 16.

Panels 12, 14, 14A, and 16 are each provided with an aperture adjacent to one side thereof, 12', 14', 14A' and 16' respectively, which are so positioned as to be in vertical registration when top back support panel 14 and bottom leg support panel 12 are folded into their overlaying positions with respect to middle seat support panel 16 and thus form a handle to facilitate ease of carrying folded chair 10. A fifth aperture 14" is also provided in top back support panel 14 in order to provide a means to secure the top ends of a towel (not shown) to chair 10 when it has been unfolded and is ready for use on the beach or the like. Finally, it should be appreciated that the preferred folded configuration is as shown in FIG. 1 with top panel 14 folded immediately over middle panel 16, with bottom panel 12 then folded upon top panel 14. In this configuration, middle panel 16 and bottom panel 12 serve as the outside surfaces of chair 10 when it is in its folded configuration. Top panel 14 with overlaying support panels 14A , 14B is sandwiched between the aforementioned top and bottom panels so as to form a compact and lightweight structure for carrying.

It will be understood that various details of the invention may be changed without departing from the scope of the invention. Furthermore, the foregoing description is for the purpose of illustration only, and not for the purpose of limitation—the invention being defined by the claims

What is claimed is:

1. A folding paperboard chair scored and cut to form a beach chair or the like, said chair comprising:

an elongated paperboard body having two spaced-apart and transversely extending score lines which define a bottom leg support panel, a middle seat support panel, and a top back support panel, said bottom and top panels being adapted to fold upwardly and over said middle panel so as to overlay same for ease of carrying said chair in a closed configuration;

a plurality of spaced-apart, foldable support panels extending transversely across the back of said top back support panel to provide support for said top panel when said chair is in an open configuration and which are adapted to fold upon and overlay said top panel when said top panel is folded to overlay said middle panel; and an aperture defined by each of said bottom, middle and top panels and adjacent to one side thereof so as to be in registration and thereby to form a carrying handle when said chair is in a closed configuration and said top and bottom panels overlay said middle panel.

2. A folding paperboard chair according to claim 1 wherein said bottom panel, said middle panel, and said top panel are of substantially the sam width and length.

3. A folding paperboard chair according to claim 1 wherein said plurality of support panels comprises two foldable support panels, the first support panel being positioned across the medial portion of said top panel and the second support panel being positioned across the top portion of said top panel, said second support panel being of greater length than said first support panel.

4. A folding paperboard chair according to claim 3 wherein said first and second support panels are connected together by a cord secured at each end thereof to a respective one of said panels.

5. A folding paperboard chair according to claim 3 wherein said first and second support panels are foldably secured to said top back panel with an adhesive tape.

6. A folding paperboard chair according to claim 1 wherein said paperboard chair comprises double wall flute-type cardboard.

* * * * *